US008651637B2

(12) United States Patent
Ishibe et al.

(10) Patent No.: US 8,651,637 B2
(45) Date of Patent: Feb. 18, 2014

(54) LIQUID SUPPLY DEVICE, IMAGE PRINTING APPARATUS, AND LIQUID CONTAINER

(75) Inventors: Akinari Ishibe, Toyohashi (JP); Hirotake Nakamura, Nagoya (JP); Hiroaki Yazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 448 days.

(21) Appl. No.: 12/957,057

(22) Filed: Nov. 30, 2010

(65) Prior Publication Data

US 2011/0310193 A1 Dec. 22, 2011

(30) Foreign Application Priority Data

Jun. 17, 2010 (JP) ..... 2010-137801

(51) Int. Cl.
*B41J 2/175* (2006.01)
*B41J 2/17* (2006.01)

(52) U.S. Cl.
USPC ..... 347/86; 347/84; 347/85

(58) Field of Classification Search
USPC ..... 347/84, 85, 86
See application file for complete search history.

(56) References Cited

U.S. PATENT DOCUMENTS

| | | | |
|---|---|---|---|
| 2008/0198210 | A1 | 8/2008 | Umeda |
| 2008/0239036 | A1 | 10/2008 | Hattori |
| 2010/0085404 | A1 | 4/2010 | Akiyama |

FOREIGN PATENT DOCUMENTS

| | | | |
|---|---|---|---|
| EP | 1790480 | A1 | 5/2007 |
| EP | 1839873 | A1 | 10/2007 |
| JP | 2005-288866 | A | 10/2005 |
| WO | 98/55320 | A1 | 12/1998 |
| WO | 02/064374 | A1 | 8/2002 |

OTHER PUBLICATIONS

European Patent Office, European Search Report for European Patent Application No. 10190191.6 (counterpart to above-captioned patent application), dated Feb. 21, 2011.

*Primary Examiner* — Jannelle M Lebron

(74) *Attorney, Agent, or Firm* — Baker Botts L.L.P.

(57) ABSTRACT

A liquid supply device includes a liquid container having a liquid chamber and a contact portion, and a mounting portion having an opening, and first and second surfaces. The liquid container is inserted into and removed from the mounting portion via the opening. The mounting portion includes an urging member that urges the liquid container toward the opening, a retaining member that selectively retains the liquid container in the mounting portion, and a stopper having a bendably deformable resilient member that extends from one of the first and second surfaces in a direction opposite the insertion direction of the liquid container, and that contacts the contact portion of the liquid container in the mounting portion. A first force required for deforming the resilient member in the insertion direction is less than a second force required for deforming the resilient member in the removal direction.

20 Claims, 11 Drawing Sheets

LIQUID SUPPLY DEVICE, IMAGE PRINTING APPARATUS, AND LIQUID CONTAINER

CROSS REFERENCE TO RELATED APPLICATION

The present application claims priority to and the benefit of Japanese Patent Application No. 2010-137801, which was filed on Jun. 17, 2010, the disclosure of which is incorporated herein by reference in its entirety.

BACKGROUND OF THE INVENTION

1. Field of the Invention

The present invention relates to a liquid supply device comprising a liquid container configured to be mounted to a mounting portion comprising a stopper, an image printing apparatus comprising such a liquid supply device, and such a liquid container.

2. Description of Related Art

A known image printing apparatuses is configured to print images on a sheet of paper using ink. The image printing apparatuses has an ink-jet print-head configured to selectively eject ink droplets from nozzles of the print-head toward the sheet of paper. A desired image is printed on the sheet of paper when the ink droplets land on the sheet of paper. The image printing apparatuses has a liquid container which contains ink to be supplied to the print-head. One example of the liquid container is a liquid cartridge, which is configured to be inserted into and removed from a mounting portion provided in the image printing apparatus. A liquid cartridge storing ink is also referred to as an ink cartridge.

When the ink cartridge runs out of ink, the ink cartridge is removed from the mounting portion of the image printing apparatus, and a new ink cartridge having ink stored therein is mounted to the mounting portion. The mounting portion has a locking structure configured to lock or retain the ink cartridge in a specific position in the mounting portion. The mounting portion also has an urging member configured to urge the ink cartridge positioned in the mounting portion in a direction in which the ink cartridge is removed from the mounting portion when the ink cartridge is locked or retained by the locking structure. When a user intends to removed the ink cartridge from the mounting portion, the ink cartridge is released from the locked state, and the ink cartridge moves toward the outside of the mounting portion with a force applied by the urging member.

Accordingly, a user is allowed to readily remove the ink cartridge from the mounting portion. When the ink cartridge is moved with a great force, the ink cartridge may jump out of the mounting portion. If the ink cartridge jumps out of the mounting portion, the ink cartridge may fall down and contact a surface, and the impact of contacting the surface may cause the ink stored in the ink cartridge to splash out. The cartridge also may be broken when the ink cartridge contacts the surface.

A known mounting portion has a structure for preventing the ink cartridge from jumping out of the mounting portion. More specifically, the mounting portion has a resiliently deformable claw hook, and the claw hook is configured to engage an edge of an engaging recess formed in a bottom surface of an ink cartridge when the ink cartridge moves toward the outside of the mounting portion. With this engagement, the ink cartridge is prevented from jumping out of the mounting portion.

The engagement between the ink cartridge and the claw hook is intended when the ink cartridge is removed from the cartridge mounting portion. However, when the ink cartridge is inserted into the mounting portion, this engagement may generate a force against the insertion operation of the ink cartridge, and may impair an operational feeling.

SUMMARY OF THE INVENTION

Therefore, a need has arisen for a liquid supply device, an image printing apparatus, and a liquid container, which overcome these and other shortcomings of the related art. Also, there is a demand for cost reduction of image printing apparatuses, and therefore it is desirable that the structure for preventing an ink cartridge from jumping out of a mounting portion is simple at low cost. A technical advantage of the invention is that the likelihood that a liquid container jumps out of a mounting portion is reduced, and the liquid container is relatively smoothly inserted into the mounting portion, with a simple and low-cost structure.

In an embodiment of the invention, a liquid supply device comprises a liquid container comprising a liquid chamber configured to store liquid therein and at least one contact portion. The liquid supply device also comprises a mounting portion having an opening, a first surface, and a second surface opposite the first surface, wherein the liquid container is configured to be inserted into the mounting portion in an insertion direction via the opening and to be removed from the mounting portion in a removal direction opposite the insertion direction via the opening. The mounting portion comprises an urging member configured to urge the liquid container positioned in the mounting portion toward the opening, at least one stopper comprising a resilient member extending from at least one of the first surface and the second surface in a direction intersecting the insertion direction, wherein the resilient member is bendably deformable in both the insertion direction and the removal direction, and wherein the resilient member is configured to contact the at least one contact portion when the liquid container is inserted into and removed from the mounting portion, and a retaining member configured to selectively retain the liquid container in the mounting portion against an urging force of the urging member. When the liquid container is mounted in the mounting portion, the at least one contact portion faces the at least one of the first surface and the second surface from which the resilient member of the at least one stopper extends, and the resilient member is configured such that a first force required for deforming the resilient member in the insertion direction is less than a second force required for deforming the resilient member in the removal direction.

In another embodiment of the invention, an image printing apparatus comprises a liquid supply device. The liquid supply device comprises a liquid container comprising a liquid chamber configured to store liquid therein, and at least one contact portion. The liquid supply device also comprises a mounting portion having an opening, a first surface, and a second surface opposite the first surface, wherein the liquid container is configured to be inserted into the mounting portion in an insertion direction via the opening and to be removed from the mounting portion in a removal direction opposite the insertion direction via the opening. The mounting portion comprises an urging member configured to urge the liquid container positioned in the mounting portion toward the opening, at least one stopper comprising a resilient member extending from at least one of the first surface and the second surface in a direction intersecting the insertion direction, wherein the resilient member is bendably deformable in both the insertion direction and the removal direction, and wherein the resilient member is configured to contact the at least one contact portion when the liquid container is inserted into and removed from the mounting portion, and a retaining member configured to selectively retain the liquid container in the mounting portion against an urging force of the urging member. The image printing apparatus also comprises a printing portion configured to selectively eject liquid supplied from the liquid supply device. When the liquid container is mounted in the mounting portion, the at least one contact portion faces the at least one of the first surface and the second surface from which the resilient member of the at least one stopper extends, and the resilient member is configured such that a first force required for deforming the resilient member in the insertion direction is less than a second force required for deforming the resilient member in the removal direction.

In yet another embodiment of the invention, a liquid container is configured to be removably inserted into a mounting portion in an insertion direction via an opening, and to be removed in a removal direction opposite the insertion direction. The liquid container comprises a liquid chamber configured to store liquid therein, at least one container surface configured to face at least one of a first surface and a second surface opposite the first surface of the mounting portion, and at least one container protrusion extending from the at least one container surface, wherein when the liquid container is inserted into the mounting portion and when the liquid container is removed from the mounting portion, the at least one container protrusion is configured to contact and deform a deformable resilient member extending from at least one of the first surface and the second surface of the mounting portion in a direction intersecting the insertion direction, wherein the at least one container protrusion is configured to exert a first force required for the container protrusion to deform the resilient member in the insertion direction when the liquid container is inserted into the mounting portion, and to exert a second force for deforming the resilient member in the removal direction when the liquid container is removed from the mounting portion, wherein the first force is less than the second force.

Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-11, like numerals being used for like corresponding parts in the various drawings.

Figure 1:
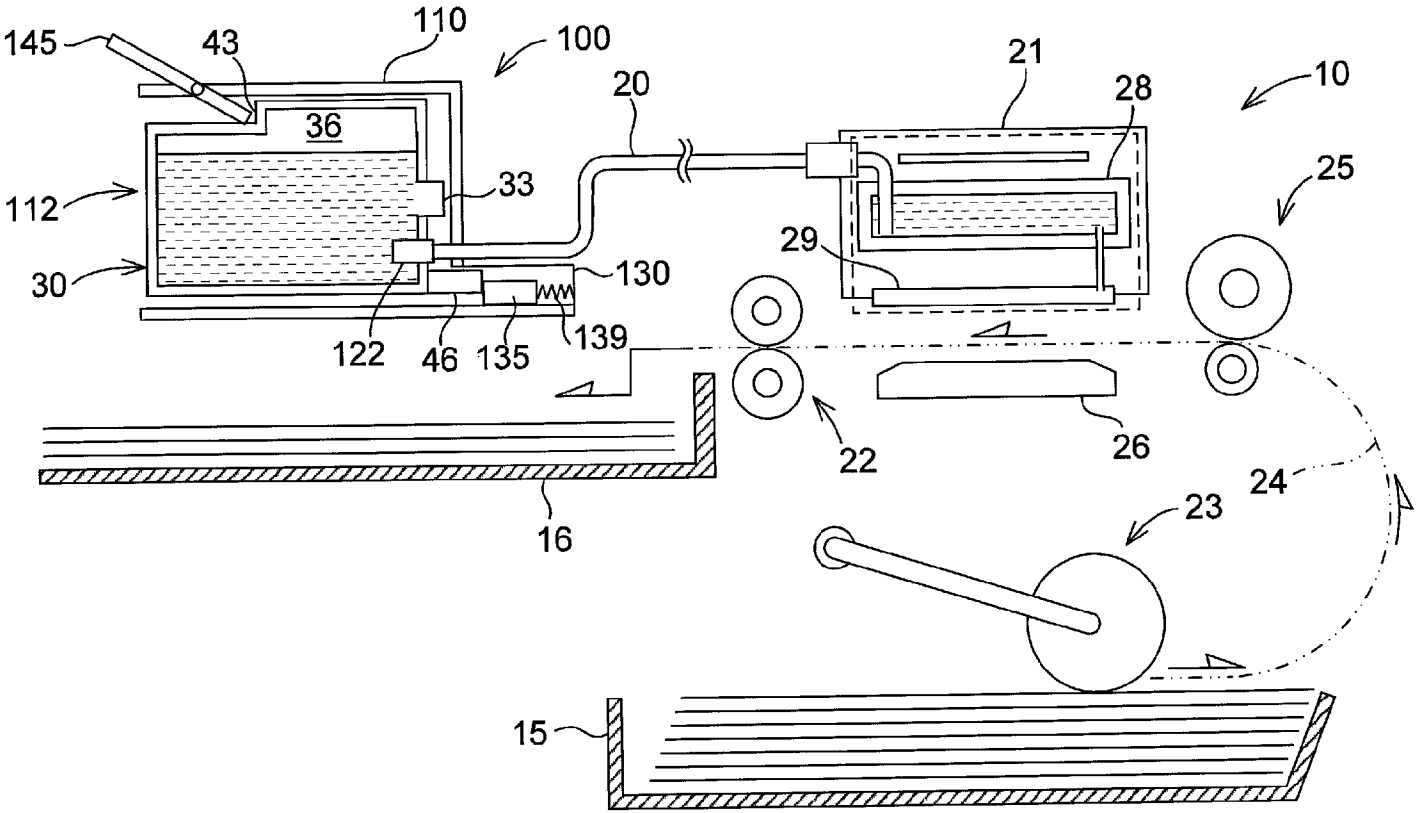
FIG. 1 is a schematic cross-sectional view of a printer comprising an ink supply device, according to an embodiment of the invention.
Figure 2:
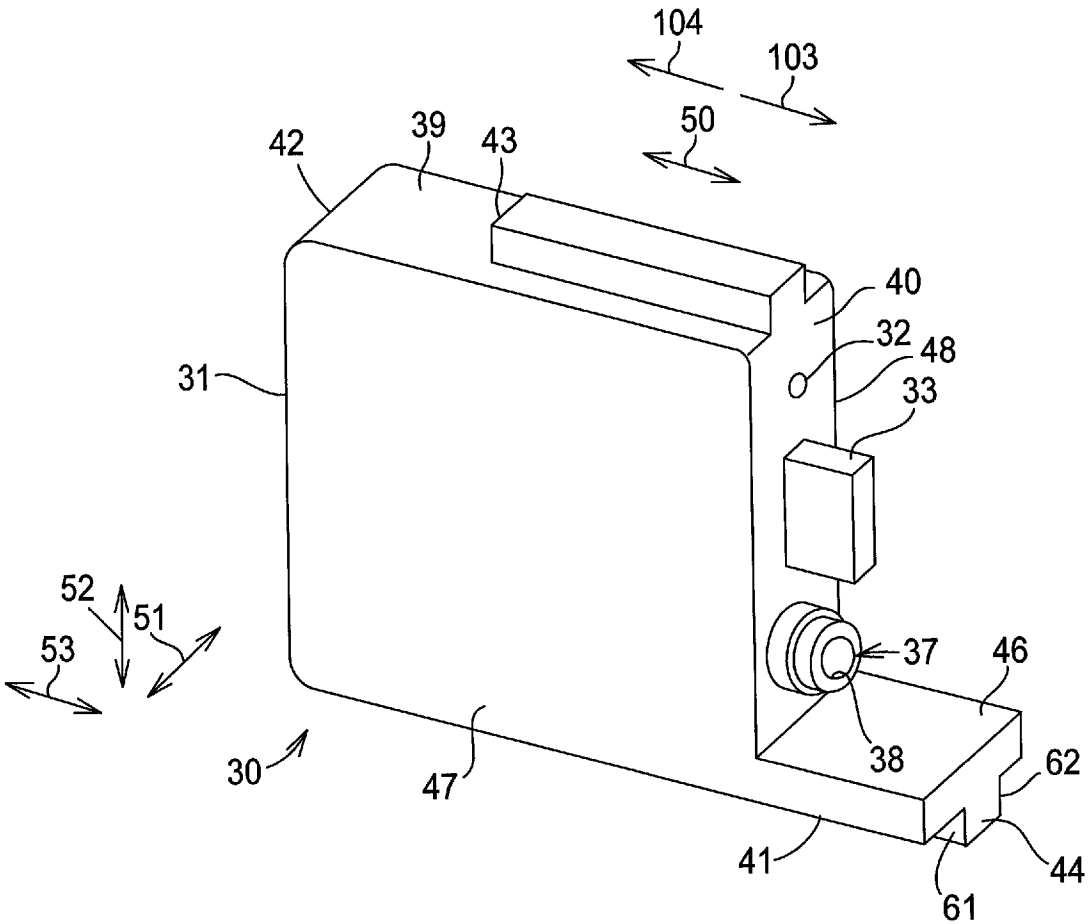
FIG. 2 is a perspective view of an ink cartridge according to an embodiment of the invention.

Referring to FIG. 1, an image printing apparatus, e.g., printer 10, may be configured to print an image by selectively ejecting ink droplets on a printing sheet of paper. The printer 10 may comprise a liquid supply device, e.g., ink supply device 100. The ink supply device 100 may comprise a mounting portion 110. An ink cartridge 30 may be allowed to be mounted to mounting portion 110 therein. The mounting portion 110 may have an opening 112 formed therein, such that an interior of the mounting portion 110 is configured to be exposed to the outside of the mounting portion 110 via the opening 112. As shown in FIG. 2, the ink cartridge 30 may be configured to be inserted into the mounting portion 110 in an insertion direction 103 via the opening 112, and thereby may be removably mounted in the mounting portion 110. The ink cartridge 30 also may be configured to be removed from the mounting portion 110 in a removal direction 104 via the opening 112. The removal direction 104 may be substantially opposite to the insertion direction 103. In an embodiment, the insertion direction 103 and the removal direction 104 are substantially a horizontal direction.

The ink cartridge 30 may be configured to store ink, which ink may be usable by the printer 10. The printer 10 may comprise at least one printing portion, e.g., ink-jet print-head 21, and at least one ink tube 20. When the ink cartridge 30 is mounted in the mounting portion 110, the ink cartridge 30 and the print-head 21 may be in fluid communication via the ink tube 20. The print-head 21 may comprise a sub tank 28. The sub tank 28 may be configured to temporarily store ink supplied via the ink tube 20 from the ink cartridge 30. The print-head 21 may be configured to selectively eject ink supplied from the sub tank 28 through nozzles 29.

A paper feed roller 23 may feed a sheet, e.g., a printing sheet of paper, from a paper feed tray 15 to a conveying path 24. A conveying roller pair 25 may convey the fed sheet onto a platen 26. The print-head 21 may be configured to selectively eject ink onto the sheet as the sheet passes over the platen 26, thereby printing an image on the sheet. Once the sheet has passed over the platen 26, a discharge roller pair 22 may convey and discharge the sheet to a paper discharge tray 16, which may be disposed at the most downstream side of the conveying path 24.

Figure 3:
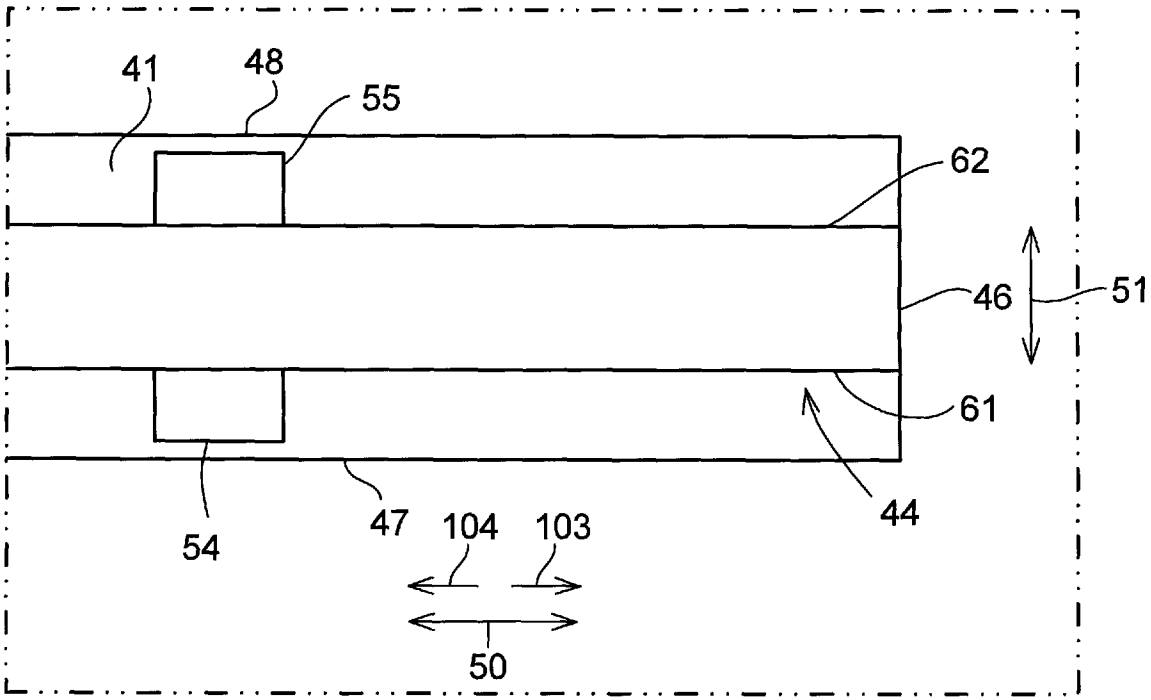
FIG. 3 is an enlarged bottom view of the ink cartridge of FIG. 2 in the vicinity of contact portions.
Figure 4:
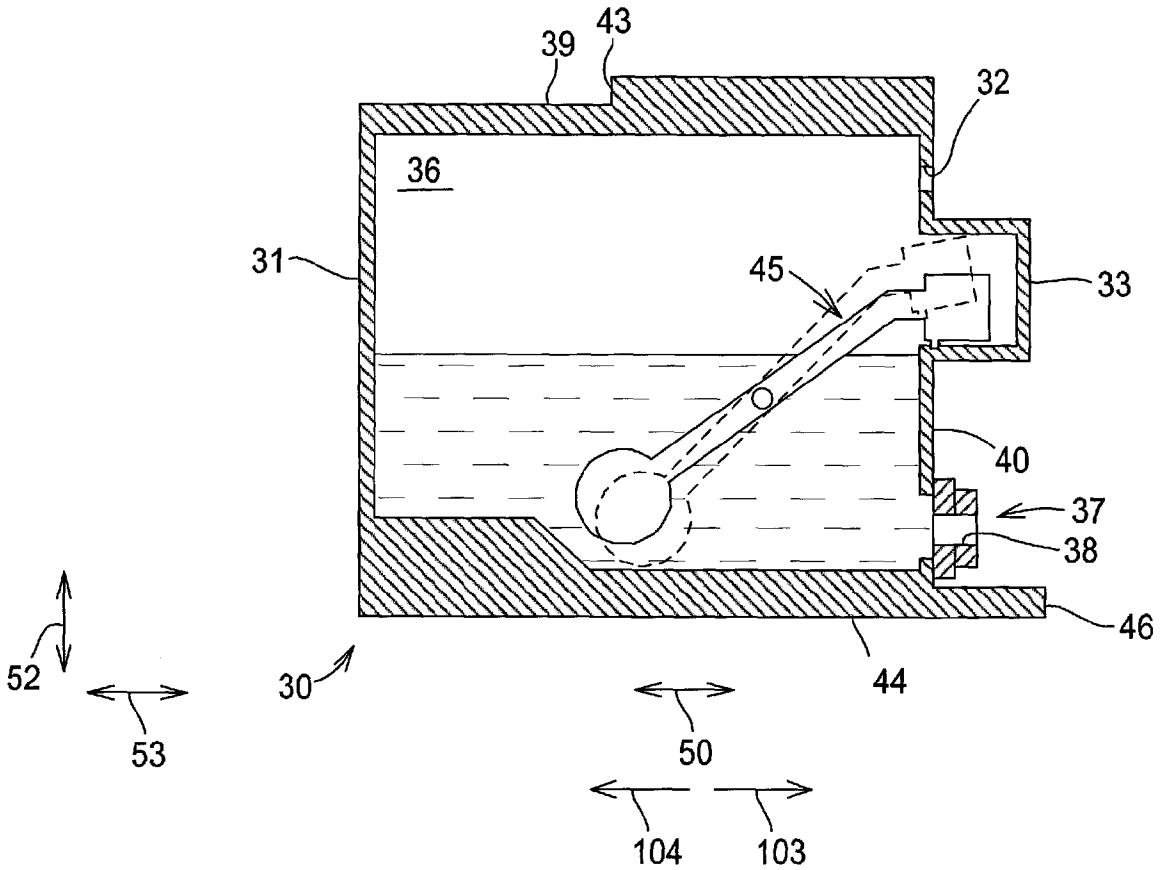
FIG. 4 is a cross-sectional view of the ink cartridge of FIG. 2.

Referring to FIGS. 2-4, a liquid container, e.g., ink cartridge 30, may be a container configured to store ink therein. The ink cartridge 30 may comprise a main body 31 forming an outer appearance of the ink cartridge 30. A liquid chamber, e.g., ink chamber 36 may be formed as a space that is formed in the interior of the ink cartridge 30. In an embodiment of the invention, the ink chamber 36 may be a space directly formed in the interior of the main body 31. In another embodiment, the ink chamber 36 may be a space formed in the interior of a container which is disposed in the main body 31.

As shown in FIG. 2, the ink cartridge 30 may be configured to be selectively inserted into and removed from the mounting portion 110 in a substantially upright position. The top surface of the ink cartridge 30, as shown in FIG. 2, may face upward and the bottom surface of the ink cartridge 30 may face downward. The ink cartridge 30 may be configured to be inserted into the mounting portion 110 in the insertion direction 103 and to be removed from the mounting portion 110 in the removal direction 104. In other words, the ink cartridge 30 is configured to be inserted into and removed from the mounting portion 110 in insertion/removal directions 50, which are the combination of the insertion direction 103 and the removal direction 104.

The main body 31 of the ink cartridge has substantially a parallelepiped shape. The main body 31 has a width in a width direction 51, a height in a height direction 52, and a depth in a depth direction 53. The width direction 51, the height direction 52, and the depth direction 53 are substantially perpendicular to each other. The width of the main body 31 may be less than the height and the depth of the main body 31. A front wall 40 may be a wall of the main body 31 positioned on the front side of the main body 31 when the ink cartridge 30 is inserted into the mounting portion 110. A rear wall 42 may be a wall of the main body 31 position on the rear side of the main body 31 when the ink cartridge 30 is inserted into the mounting portion 110. The front wall 40 and the rear wall 42 may be substantially aligned in the depth direction 53. When the ink cartridge 30 is inserted into the mounting portion 110, the depth direction 53 may be substantially parallel to the insertion/removal directions 50, and the width direction 51 and the height direction 52 may be substantially perpendicular to the insertion/removal directions 50. Therefore, when the ink cartridge 30 is inserted into the mounting portion 110, the front wall 40 and the rear wall 42 may be substantially aligned in the insertion/removal directions 50.

Figure 5:
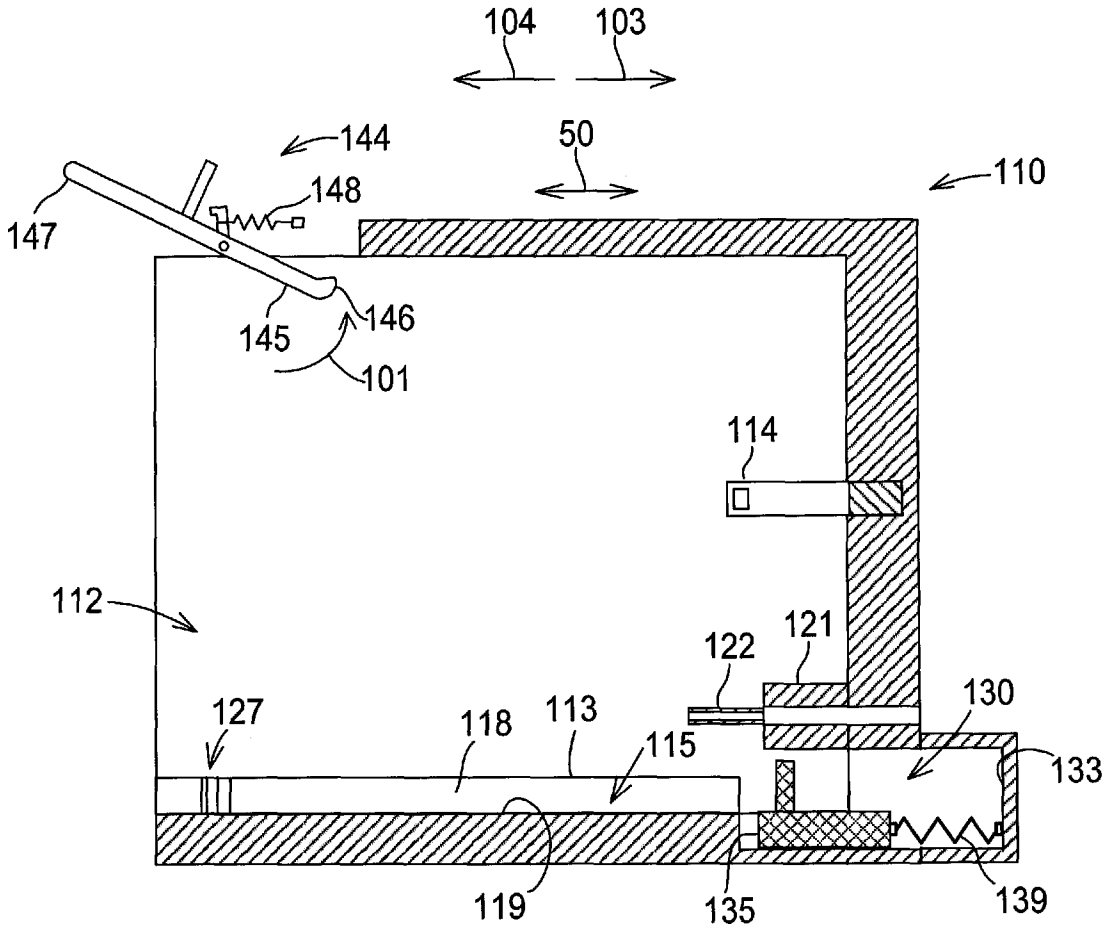
FIG. 5 is a cross-sectional view of a mounting portion of the ink supply device of FIG. 1.

The main body 31 may comprise a remaining amount detection portion 33 disposed at the front wall 40 of the main body 31 at substantially the center of the front wall in the height direction 52. The remaining amount detection portion 33 may have substantially a box shape having an opening, through which the inside of the remaining amount detection portion 33 may be in fluid communication with the inside of the ink chamber 36. The remaining amount detection portion 33 may comprise a pair of walls, which may comprise a light-transmissive resin. As shown in FIG. 5, the pair of walls of remaining amount detection portion 33 may allow infrared light emitted from an optical sensor 114 provided in the mounting portion 110 to pass therethrough.

When the ink cartridge 30 is mounted in the mounting portion 110, depending on the amount of ink in the ink chamber 36, the remaining amount detection portion 33 may be configured to either allow the infrared light emitted from the optical sensor 114 to pass therethrough, or may block or substantially attenuate the infrared light. Whether the remaining amount detection portion 33 allows the infrared light to pass therethrough or block or substantially attenuate the infrared light is detected and a controller of the printer is told whether the amount of ink stored in the ink chamber 36 is less than a predetermined amount.

For example, the remaining amount detection portion 33 may comprise an opaque detection element 45 positioned in the inside of the remaining amount detection portion 33. The detection element 45 may move relative to the amount of ink stored in the ink chamber 36, and the remaining amount detection portion 33 may be configured to either allow the infrared light emitted from the optical sensor 114 to pass therethrough, or to block or substantially attenuate the infrared light, depending on the movement of the detection element 45. More specifically, the detection element 45 may be configured to move between a position where the detection element 45 intersects the optical path of the infrared light and a position where the detection element 45 does not intersect the optical path of the infrared light. A wall of the remaining amount detection portion 33 which is irradiated with the infrared light of the optical sensor 114 may extend in the vertical direction, e.g., height direction 52, or in a direction intersecting the vertical direction, e.g., height direction 52.

The main body 31 may comprise an atmospheric air communication opening 32 formed through the front wall 40, and the atmospheric air communication opening 32 may be positioned above the remaining amount detection portion 33. The atmospheric air communication opening 32 may penetrate through the front wall 40 in the depth direction 53. As described above, the ink chamber 36 is configured to store ink therein, and an air layer may be formed above the ink surface of the ink stored in the ink chamber 36. The air in the air layer of ink chamber 36 and atmospheric air outside the main body 31 may be brought into fluid communication with each other via the atmospheric air communication opening 32. Although not shown in the respective drawings, in an embodiment of the invention, the atmospheric air communication opening 32 may be configured to be selectively opened and closed by a valve.

When the atmospheric air communication opening 32 is opened, the air pressure in the ink chamber 36 may become equal to the atmospheric pressure outside the main body 31. In the embodiment shown in the figures, the atmospheric air communication opening 32 may be positioned at front wall 40. Nevertheless, the atmospheric air communication opening 32 is not required to be positioned at the front wall 40, and in other embodiments of the invention, the atmospheric air communication opening 32 may be placed at other positions, while maintaining the configuration to allow the interior and the exterior of the ink chamber 36 to be brought into communication with each other via the atmospheric air communication opening 32. Moreover, in yet another embodiment of the invention, when the ink cartridge 30 is used in embodiments in which the inside of the ink chamber 36 is kept in a negative pressure, the atmospheric air communication opening 32 may be omitted.

The main body 31 may comprise an ink supply portion 37 positioned at the front wall 40 below the remaining amount detection portion 33. The ink supply portion 37 may have a substantially cylindrical outer surface, and may protrude outward from the front wall 40 in the insertion direction 103. The ink supply portion 37 may have an ink flow channel 38 formed therein, and the ink flow channel 38 may extend in the insertion/removal directions 50. As shown in FIGS. 1 and 5, the ink supply portion 37 may be configured such that ink may flow out from the ink chamber 36, through the ink flow channel 38, and into an ink supply tube 122, which may be disposed in the mounting portion 110.

Referring to FIGS. 2 and 4, the main body 31 may comprise an upper wall 39 extending from the upper end of the front wall to the upper end of the rear wall 42. The main body 31 also may comprise an engaging portion 43 at substantially the center of the upper wall 39 in the depth direction 53. The engaging portion 43 may comprise a plane extending in the width direction 51 and the height direction 52. A locking lever 145, described later with respect to FIG. 5, may be configured to engage the engaging portion 43 when the ink cartridge 30 is mounted in the mounting portion 110. The main body 31 also may comprise a projection 46. The projection 46 may extend from the lower end of the front wall 40 of the main body 31, in the insertion direction 103, and away from the rear wall 42. The projection 46 may be disposed below the ink supply portion 37. The width of the projection 46 may be substantially equal to the width of the front wall 40 in the width direction 51. The distal end of the projection 46 may extend to a position further from the ink chamber 36 than the distal end of the ink supply portion 37.

As shown in FIGS. 2-4, the main body 31 may comprise a lower wall 41 opposite the upper wall in the height direction 52, and the ink cartridge 30 may comprise a guide portion 44 extending downward from the lower wall 41. The guide groove 44 may extend in the depth direction 53. As shown in FIG. 3, the guide portion 44 may comprise surfaces 61, 62 extending in the height direction 52 and the depth direction 53, and opposing to each other in the width direction 51. The surfaces 61, 62 may be disposed closer to the central interior of ink cartridge 30 than a right end surface 47 and a left end surface 48 of the main body 31 in the width direction 51. In other words, the guide portion 44 may be narrower than the main body 31 in the width direction 46. When the ink cartridge 30 is inserted into and removed from the mounting portion 110, the guide portion 44 may be configured to be inserted into and move in a groove 115, which will be described later with respect to FIGS. 5 and 6. The surfaces 61, 62 of the guide portion 44 may be configured to face side surfaces 117, 118 when the ink cartridge 30 is inserted into and removed from the mounting portion 110. Side surfaces 117, 118 may partially define the groove 115.

Referring to FIG. 3, the ink cartridge 30 may comprise a contact portion 54 protruding from the surface 61 of the guide portion 44 outward in the width direction 51. The ink cartridge 30 also may comprise a contact portion 55 protruding outward in the width direction 51 from the surface 62 of the guide portion 44. The contact portion 54 and the contact portion 55 may protrude from the surface 61 and the surface 62, respectively, in the opposite directions. The contact portion 54 and the contact portion 55 may be disposed at the same position in the insertion/removal directions 50, such that the contact portion 54 and the contact portion 55 may be substantially aligned in the width direction, which is perpendicular to the insertion/removal directions 50. When the ink cartridge 30 is mounted in the mounting portion 110, the contact portions 54, 55 may face and protrude toward the side surfaces 117, 118, respectively, of the groove 115, shown in FIGS. 5 and 6. When the ink cartridge 30 is inserted into and removed from the mounting portion 110, the contact portions 54, 55 may be configured to contact resilient members 81, 86 of stoppers 124, 125, respectively, which will be described later with respect to FIG. 6. In the embodiment shown in the figures, the contact portions 54, 55 each may be formed into a parallelepiped shape having a substantially rectangular shape when viewed in a bottom view. Nevertheless, the shape of the contact portion is not limited thereto, and in other embodiments of the invention, the contact portions 54, 55 may have various shapes not limited to those illustrated.

As shown in FIG. 3, the distal ends of the contact portions 54, 55 may be disposed closer to the central interior of ink cartridge 30 than the right end surface 47 and the left end surface 48 of the main body 31 in the width direction 51. The width of the main body 31 in the width direction 51, e.g., the distance between the right end surface 47 and the left end surface 48 in the width direction 51, may be greater than the width of the guide portion 44 including the contact portions 54, 55 in the width direction 51, e.g., the distance between the distal ends of the contact portions 54, 55 in the width direction 51. Therefore, the contact portions 54, 55 may not extend beyond the right end surface 47 and the left end surface 48 in the width direction. Moreover, the width of the guide portion 44, including the contact portions 54, 55 in the width direction 51, e.g., the distance between the distal ends of the contact portions 54, 55 in the width direction 51, may be less than the distance between the side surfaces 117, 118 of the groove 115 in the width direction. Thus, when the ink cartridge 30 inserted into and the removed from the mounting portion 110, the contact portions 54, 55 may be allowed to enter the groove 115 and may move smoothly in the insertion/removal direction 50 in the groove, unless contact portions 54, 55 come into contact with the resilient members 81, 86 of the stoppers 124, 125.

Referring to FIGS. 1 and 5, as described above, the mounting portion 110 may have the opening 112, and the ink cartridge 30 may be configured to be inserted into the mounting portion 110 in the insertion direction 103 via the opening 112 and thereby mounted in the mounting portion 110. The ink cartridge 30 also may be configured to be removed from the mounting portion 110 in the removal direction 104 via the opening 112. The mounting portion 110 may have a groove 115 formed in a bottom surface 113 which may define the bottom of the inner space of the mounting portion 110. The groove 115 may extend from the opening 112 in the insertion direction 103. When the ink cartridge 30 is inserted into and removed from the mounting portion 110, the ink cartridge 30 may be guided in the insertion/removal directions 50 by the guide portion 44 positioned in the groove 115.

Referring to FIG. 5, the mounting portion 110 may comprise the optical sensor 114, a locking mechanism 144, a sliding member 135, a coil spring 139, a joint portion 121, and the stoppers 124, 125. The optical sensor 114 may be provided at an end portion of the mounting portion 110 opposite the opening 112 in the insertion/removal directions 50. The optical sensor 114 may be a photo interrupter comprising a light-emitting element, e.g., a light-emitting diode, configured to emit infrared light, and a light-receiving element, e.g., a photo transistor, configured to receive the infrared light emitted from the light-emitting element. When the mounting portion 110 is positioned as shown in FIG. 5, the light-emitting element and the light-receiving element may be aligned in a direction perpendicular to the plane formed by the paper on which FIG. 5 is illustrated.

When the ink cartridge 30 is positioned in the mounting portion 110, the remaining amount detection portion 33 may be positioned between the light-emitting element and the light-receiving element of the optical sensor 114. When the ink cartridge 30 is positioned in the mounting portion 110, the controller of printer 10 may determine whether the remaining amount of ink stored in the ink chamber 36 is less than the predetermined amount, depending on whether the light-receiving element of the optical sensor 114 received the infrared light passing the through the remaining amount detection portion 33.

The sliding member 135 may be disposed in a space 130 formed in the lower end of the end portion of the mounting portion 110. The space 130 may be contiguous with the inner space of the mounting portion 110. The sliding member 135 may be configured to slide in the insertion/removal directions 50 in the space 130. The sliding member 135 may be disposed in the line of the travel of the projection 46, such that the ink cartridge 30 may come into contact with the projection 46 when the ink cartridge 30 is inserted in to the mounting portion 110.

Figure 7:
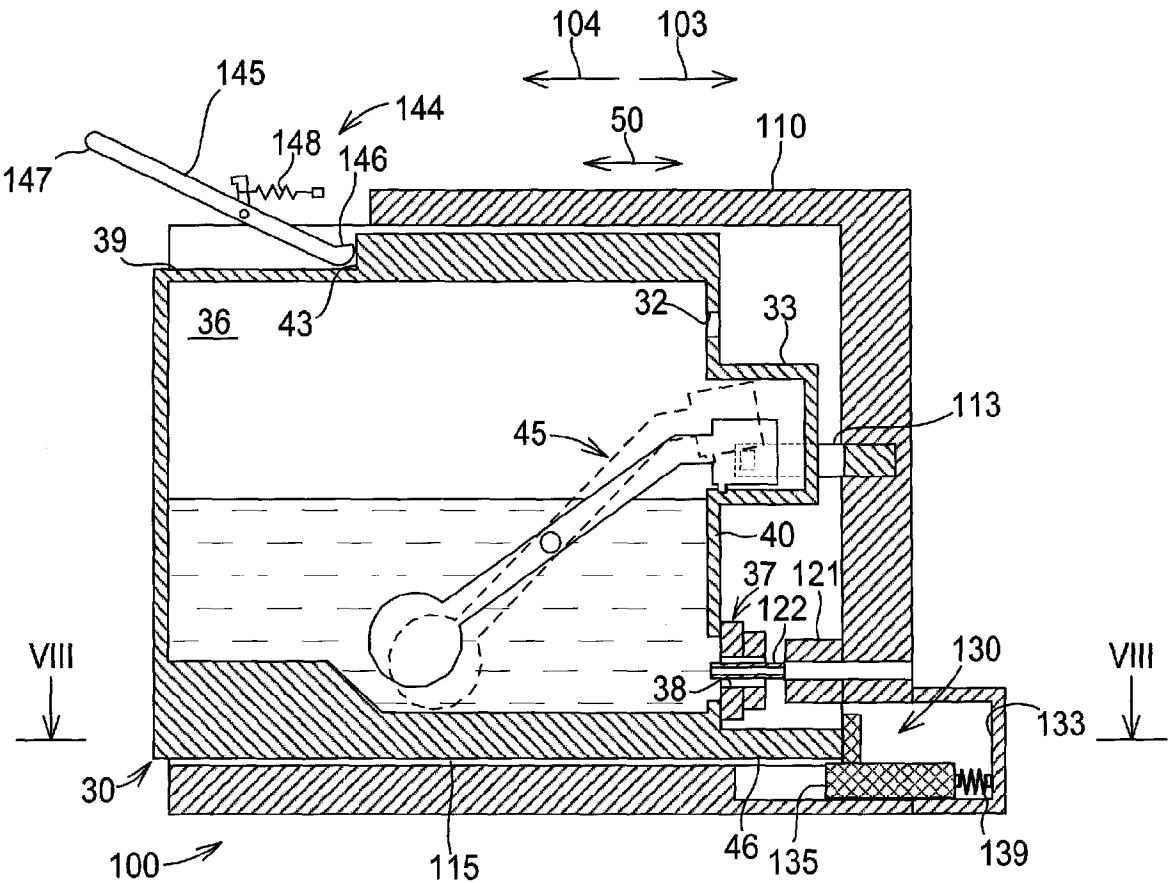
FIG. 7 is a cross-sectional view of the ink cartridge of FIG. 2 and the mounting portion of FIG. 5, in which the ink cartridge is mounted in the mounting portion.

The coil spring 139 may be disposed in the space 130. The coil spring 139 may be configured to resiliently bias the sliding member 135 toward the opening 112, that is, in the removal direction 104. The coil spring 139 may extend in the insertion/removal directions 50 in the space 130, and one end of the coil spring 139 may be connected to a back wall 133. Back wall 133 may define an end of the space 130 opposite the inner space of the mounting portion 110 in the insertion/removal directions 50. The other end of the coil spring 139 may be connected to the sliding member 135, and coil spring 139 and sliding member 135 may be, e.g., an urging member. As shown in FIG. 5, when an external force is not applied to coil spring 139, e.g., coil spring 139 is at its natural length, e.g., when an external force is not applied to the sliding member 135, the sliding member 135 may be positioned at the and end of the space 130 closer to opening 112. The projection 46 of the ink cartridge 30 may come into contact with the sliding member 135 when the ink cartridge 30 is inserted into the mounting portion 110, and the sliding member 135 may be pressed by the ink cartridge 30 toward the back wall 133 of the space 130. Accordingly, the coil spring 139 may be contracted, and, as shown in FIG. 7, the sliding member 135 may slide to the back wall side of the space 130. The sliding member 135 and the coil spring 139 may be configured to urge the ink cartridge 30 positioned in the mounting portion 110 toward the opening 112.

As shown in FIGS. 5 and 7, the locking mechanism 144 may be configured to releasably retain the ink cartridge 30 in the mounting portion 110 against an urging force of the sliding member 135 and the spring 139, and to prevent the ink cartridge 30 from moving in the removal direction 104 when locking mechanism 144 is engaged with ink cartridge 30. The locking mechanism 144 may comprise a retaining member, e.g., locking lever 145, and a coil spring 148 which may apply an urging force to the locking lever 145. The locking lever 145 may be configured to pivot from a lock position, shown in FIG. 5, toward an unlock position in a direction indicated by an arrow 101. When an external force is not applied to the locking lever 145, the locking lever 145 may be constantly urged toward the lock position by the coil spring 148. The locking lever 145 may comprise an engaging end 146 disposed at one end of the locking lever 145 and an operating member 147 disposed at the other end of the locking lever 145. The ink cartridge 30 may be locked or retained in the mounting portion 110 when the engaging end 146 of the lock mechanism 144 engages the engaging portion 43 of the ink cartridge 30. When a user presses the operating member 147 downward, the locking lever 145 moves from the lock position to the unlock position.

The joint portion 121 may be disposed at the end portion of the mounting portion 110. The joint portion 121 may comprise ink supply tube 122. The ink supply tube 122 may be a tubular member extending substantially in the insertion/removal directions 50. The ink supply tube 122 may be in fluid communication with the ink tube 20. When the ink cartridge 30 is mounted in the mounting portion 110, the ink supply tube 122 may be inserted into the ink supply portion 37, and the joint portion 121 and the ink supply portion 37 may be joined. Accordingly, ink may be supplied from the ink chamber 36 to the ink tube 20 via the ink supply tube 122. The ink tube 20 is omitted in FIG. 5.

Figure 6:
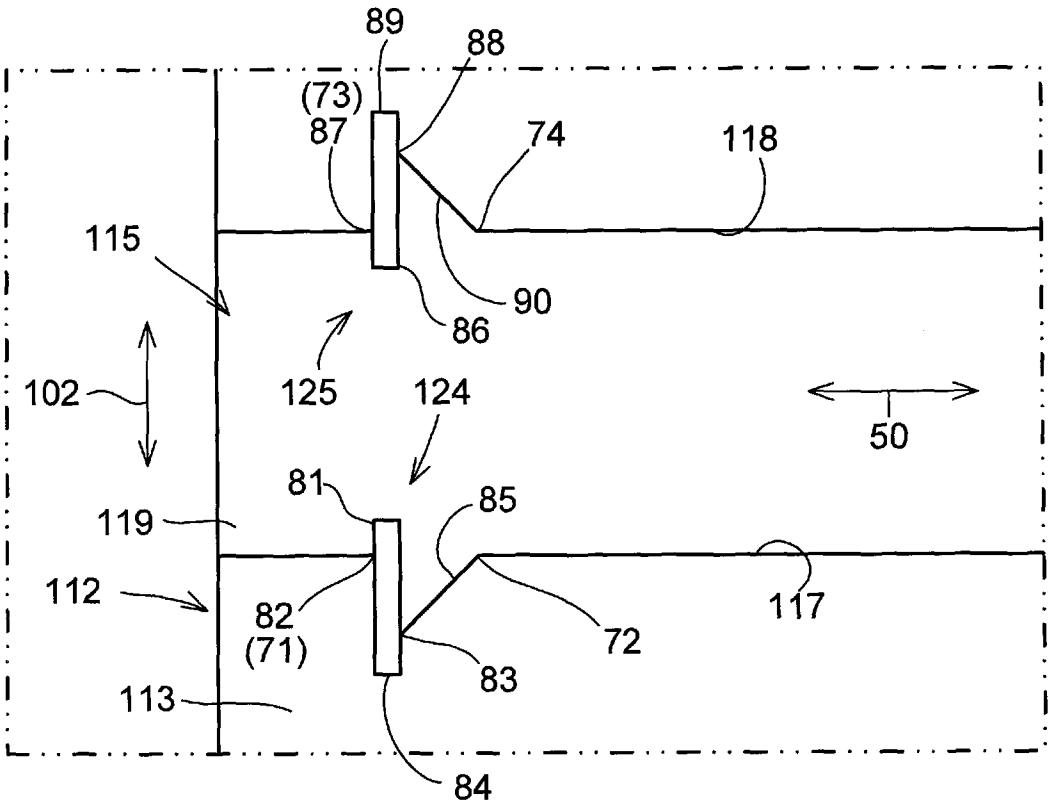
FIG. 6 is an enlarged view of the mounting portion of FIG. 5 in the vicinity of stoppers.

Referring to FIGS. 5 and 6, the bottom surface 113, which may define the bottom of the inner space of the mounting portion 110, may have the groove 115 extending from the opening 112 to the end portion of the mounting portion 110 in the insertion direction 103. The groove 115 may be a space recessed vertically downward from the bottom surface 113, defined by the side surfaces 117, 118 extending in the insertion/removal directions 50 and opposing to each other, and a bottom surface 119 which connects the side surfaces 117, 118. The side surface 117 is not shown in FIG. 5.

The stoppers 124, 125 may be disposed at the side surfaces 117, 118 of the groove 115, respectively, at positions adjacent to the opening 112. The stopper 124 may be disposed at the side surface 117 of the groove 115, and the stopper 125 may be disposed at the side surface 118 of the groove 115. The stoppers 124, 125 may be substantially aligned in a horizontal direction 102 perpendicular to the insertion/removal directions 50. The horizontal direction 102 may be parallel to the width direction 51 of the ink cartridge 30.

The stopper 124 may comprise a resilient strip 81 and a limiter, e.g., corners 82, 83, which may be configured to limit the angles at which the resilient strip 81 may deform, e.g., bend in the insertion direction 103 and the removal direction 104. The resilient strip 81 may comprise a thin rubber material having a flat plate shape, and may have a longitudinal dimension and a thickness dimension perpendicular to the longitudinal dimension. The resilient strip 81 may extend from the side surface 117, such that the longitudinal dimension may be substantially aligned with the horizontal direction 102 while the thickness direction thereof may be substantially aligned with the insertion/removal directions 50.

The resilient strip 81 has a first end and a second end opposite the first end in the longitudinal dimension. The first end side of the resilient strip 81 may be inserted into the side surface 117 of the groove 115, and the second end side of the resilient strip 81 may project from the side surface 117 toward the side surface 118 in the horizontal direction 102. A recess 84 may be formed in the side surface 117 and the recess 84 may extend from the side surface 117 away from the side surface 118. The first end side of the resilient strip 81 may be fitted into the recess 84.

The inner surface defining the recess 84 may be connected to the side surface 117 at a first boundary 71 and a second boundary 72. The first boundary 71 may be positioned closer to the opening 112 than the second boundary 72. The corner 82 may be formed by the inner surface of the recess 84 and the side surface 117 at the first boundary 71. For example, in an embodiment of the invention, the corner 82 may form an angle of 90 degrees. A portion of the resilient strip 81 projecting from the side surface 117 toward the side surface 118 may be resiliently bent in the removal direction 104 toward the opening 112 along the corner 82, and may come into contact with the side surface 117.

The corner 83 may be formed in the recess 84, e.g., the corner 83 is formed by a bending of the inner surface of the recess 84. The corner 83 may be disposed further from the opening 112 and from the side surface 118 than the corner 82. The inner surface of the recess 84 may comprise an inclined surface 85 extending between the second boundary 72 and the corner 83. The corner 83 may be disposed closer to the opening 112 than the second boundary 72. Moreover, the corner 83 may be disposed further from the side surface 118 than the second boundary 72. In an embodiment of the invention, corner 83 may form an angle of 135 degrees. A space where the resilient strip 81 may move may be formed in the recess 84 by the provision of the inclined surface 85. A portion of the resilient strip 81 may be resiliently bent in the insertion direction 103 toward the end portion of the mounting portion 110 along the corner 83 and may come into contact with the inclined surface 85.

The stopper 125 may comprise a resilient strip 86 and a limiter, e.g., corners 87, 88, which may be configured to limit angles at which the resilient strip 86 bends in the insertion direction 103 and the removal direction 104. The resilient strip 86 may comprise a rubber material having a thin flat plate shape, and may have a longitudinal dimension and a thickness dimension perpendicular to the longitudinal dimension. The longitudinal dimension may be greater than the thickness dimension. The resilient strip 86 may extend from the side surface 118 with the longitudinal dimension thereof substantially aligned with the horizontal direction 102 while the thickness dimension thereof may be substantially aligned with the insertion/removal directions 50. The resilient strip 86 has a first end and a second end opposite the first end in the longitudinal dimension. The first end side of the resilient strip 86 may be inserted into the side surface 118 of the groove 115, and the second end side of the resilient strip 86 may project from the side surface 118 of the groove 115 toward the side surface 117 in the horizontal direction 102. A recess 89 may be formed in the side surface 118 and the recess 89 may extend from the side surface 118 away from the side surface 117. The first end side of the resilient strip 86 may be fitted into the recess 89.

The inner surface defining the recess 89 may be connected to the side surface 118 at a first boundary 73 and a second boundary 74. The first boundary 73 may be closer to the opening 112 than the second boundary 74. The corner 87 may be formed by the inner surface of the recess 89 and the side surface 118 at the first boundary 73. For example, the corner 87 may form an angle of 90 degrees. A portion of the resilient strip 86 projecting from the side surface 118 toward the side surface 117 may be resiliently bent in the removal direction 104 toward the opening 112 along the corner 87 and come into contact with side surface 118.

The corner 88 may be formed in the recess 89, e.g., the corner 88 may be formed by a bending of the inner surface of the recess 89. The corner 88 may be disposed further from the opening and from the side surface 117 than the corner 87. The inner surface of the recess 89 may comprise an inclined surface 90 extending between the second boundary 74 and the corner 88. The corner 88 may be disposed closer to the opening than the second boundary 74. Moreover, the corner 88 may be disposed further from the side surface 117 than the second boundary 74. In an embodiment of the invention, the corner 88 may form an angle of 135 degrees. A space where the resilient strip 86 may move may be formed in the recess 89 by the provision of the inclined surface 90. A portion of the resilient strip 86 may be resiliently bent in the insertion direction 103 toward the end portion of the mounting portion 110 along the corner 88 and may come into contact with the inclined surface 90.

The resilient strip 81 of the first stopper 124 and the resilient strip 86 of the second stopper 125 may be disposed at the same position in the insertion/removal directions 50. In other words, the resilient strip 81 of the first stopper 124 and the resilient strip 86 of the second stopper 125 may be substantially aligned in the horizontal direction 112, which is perpendicular to the insertion/removal directions 50.

In an embodiment, the distance between the distal ends of the resilient strips 81, 86 in the horizontal direction 102 may be less than the distance between the distal ends of the contact portions 54, 55 of the guide portion 44 of the ink cartridge 30 in the width direction 51. The distance between the distal end of the contact portion 54 and the surface 61 in the width direction 51 may be greater than the distance between the second end of the resilient strip 81 and the side surface 117 in the horizontal direction 102.

Similarly, the distance between the distal end of the contact portion 55 and the surface 62 in the width direction 51 may be greater than the distance between the second end of the resilient strip 86 and the side surface 118 in the horizontal direction 102. The distance between the distal ends of the contact portions 54, 55 in the width direction 51 may be greater than the distance between the second end of the resilient strip 81 and the side surface 118 in the horizontal direction 102, and also may be greater than the distance between the second end of the resilient strip 86 and the side surface 117 in the horizontal direction 102. Moreover, the distance between the distal ends of the resilient strips 81, 86 in the horizontal direction 102 may be greater than the distance between the surfaces 61, 62 of the guide portion 44 in the width direction 51. As described above, the horizontal direction 102 and the width direction 51 are substantially parallel to each other. With these dimensional relationships, when the guide portion 44 inserted into the groove 115 moves in the insertion/removal direction 50, the contact portions 54, 55 may come into contact with the resilient strips 81, 86. In another embodiment, at least one of the resilient strips 81, 86 may come into contact with the contact portion 54 or 55 when the guide portion 44 is inserted into the groove 115 and moves in the insertion/removal direction 50. In the another embodiment, the dimensional relationships may differ from those described above.

When the ink cartridge 30 is inserted into the mounting portion 110 via the opening 112, with the front wall 40 facing forward in the insertion direction 103, the guide portion 44 of the ink cartridge 30 may be inserted into the groove 115 of the mounting portion 110. By the contact between the guide portion 44 and the groove 115, the ink cartridge 30 may be guided in the insertion/removal direction 50.

Figure 8:
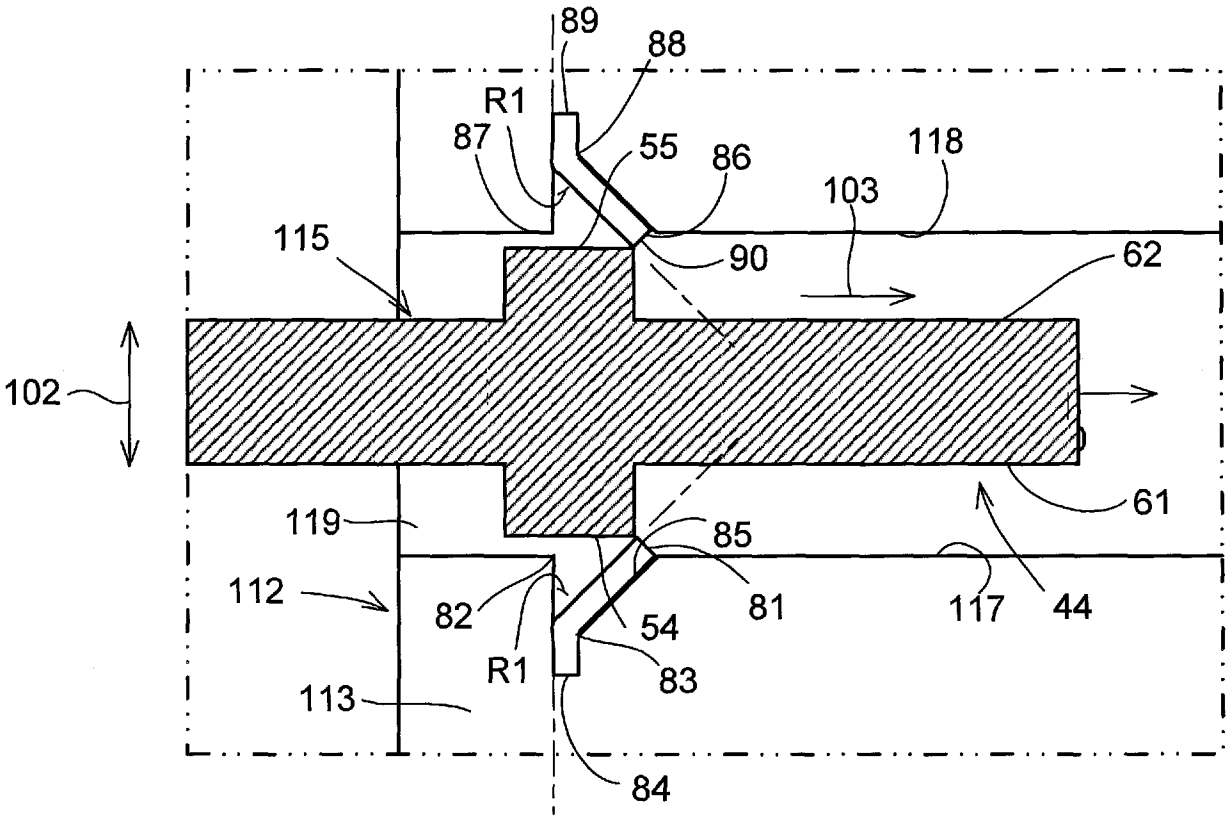
FIG. 8 is an enlarged view of the ink cartridge of FIG. 2 and the mounting portion of FIG. 5 in the vicinity of the contact portions and the stoppers, in which the ink cartridge is inserted into the mounting portion 110, corresponding to a cross-sectional view taken along line VIII-VIII in FIG. 7.

Referring to FIG. 8, during the insertion of the ink cartridge 30 into the mounting portion 110 in the insertion direction 103, the contact portions 54, 55 of the ink cartridge 30 may come into contact with the resilient strips 81, 86 of the stoppers 124, 125, respectively. When the contact portion 54 contacts and pushes the resilient strip 81 the resilient strip 81 may be resiliently bent in the insertion direction 103. The resilient strip 81 may be bent about the corner 83 as a pivot until the resilient strip 81 comes into contact with the inclined surface 85. The angle at which the resilient strip 81 is bent is an angle R1 as shown in FIG. 8. For example, in an embodiment of the invention as shown in FIG. 8, the angle R1 is 45 degrees. When the resilient strip 81 is fully bent until the resilient strip 81 contacts the inclined surface 85, the resilient strip 81 may project a shorter distance away from the side surface 117, and the contact portion 54 may move further in the insertion direction 103 with substantially no deformation of the resilient strip 81 in the thickness dimension thereof toward the side surface 117.

Similarly, when the contact portion 55 contacts and pushes the resilient strip 86, the resilient strip 86 may be resiliently bent in the insertion direction 103. The resilient strip 86 may be bent about the corner 88 as a pivot until the resilient strip 86 comes into contact with the inclined surface 90. The angle at which the resilient strip 86 is bent also may be the angle R1, which may be 45 degrees in an embodiment of the invention. When the resilient strip 86 is fully bent until the resilient strip 86 contacts the inclined surface 90, the resilient strip 86 may project a shorter distance from the side surface 118, and the contact portion 55 may move further in the insertion direction 103 with substantially no deformation of the resilient strip 86 in the thickness dimension thereof toward the side surface 118.

The angle R1 at which the resilient strips 81, 86 are bent in the insertion direction 103 when the ink cartridge 30 is inserted into the mounting portion 110 may be less than an angle R2, which will be described in more detail herein, at which the resilient strips 81, 86 are bent in the removal direction 104 when the ink cartridge 30 is removed from the mounting portion 110. Because of the angle R1 being less than the angle R2, a force required for bending the resilient strips 81, 86 in the insertion direction 103 when the ink cartridge 30 is inserted into the mounting portion 110 may be less than a force required for bending the resilient strips 81, 86 in the removal direction 104 when the ink cartridge 30 is removed from the mounting portion 110.

When the ink cartridge 30 is further inserted in the insertion direction 103, and the contact portions 54, 55 pass the stoppers 124, 125, the resilient strips 81, 86, which have been bent, may resiliently return to their original positions, such that the longitudinal directions thereof may be substantially aligned with the horizontal direction 102, as shown in FIG. 6.

Referring to FIG. 7, when the ink cartridge 30 is inserted into the mounting portion 110, the sliding member 135 may be pressed by the projection 46, and may be slid toward the back wall 133 of the space 130. Also, the coil spring 139 may contract from the natural length, and the sliding member 135 may receive a biasing force from the coil spring 139 toward the opening 112. Accordingly, the ink cartridge 30 in the mounting portion 110 may be resiliently urged in the removal direction 104 toward the opening 112.

During the insertion of the ink cartridge 30 into the mounting portion 110, the engaging end 146 of the locking lever 145 may climb onto the upper wall 39 of the ink cartridge 30. Accordingly, the locking lever 145 may pivot counterclockwise, e.g., in the direction indicated by the arrow 101 in FIG. 5, and locking lever 145 may transition from the lock position to the unlock position. When the ink cartridge 30 is further inserted, the engaging portion 43 of the ink cartridge 30 may move toward the end portion of the mounting portion 110 relative to the engaging end 146 of the locking lever 145, and the locking lever 145 may pivot to a position where the engaging end 146 engages the engaging portion 43. In other words, the locking lever 145 may pivot clockwise, and may transition from the unlock position to the lock position, as shown in FIG. 7.

Although the ink cartridge 30 urged by the sliding member 135 and the coil spring 139 may be resiliently urged to move in the removal direction 104 toward the opening 112, the ink cartridge 30 may be retained in the mounting portion 110 because the engaging end 146 of the locking lever 145 engages the engaging portion 43. The ink cartridge 30 thus may be mounted to the mounting portion 110. When the ink cartridge 30 is mounted in the mounting portion 110, the ink supply tube 122 of the joint portion 121 may be inserted into the ink flow channel 38 of the ink cartridge 30, and the supply of ink from the ink chamber 36 to the outside of the ink cartridge 30 may be enabled. When the ink supply tube 122 is inserted into the ink flow channel 38, the center of the guide portion 44 in the width direction 51 and the center of the groove 115 may be substantially aligned in the horizontal direction 102.

When a user intends to remove the ink cartridge 30 from the mounting portion 110, the user presses down the operating member 147 of the locking lever 145. Accordingly, the locking lever 145 may pivot counterclockwise, and transition from the lock position to the unlock position. When the locking lever 145 is in the unlock position, the engaging end 146 may be positioned above the engaging portion 43 of the ink cartridge 30. Accordingly, the engaging end 146 may move away from the engaging portion 43. Thus, the ink cartridge 30 may receive the urging force from the sliding member 135 and the coil spring 139, and may be moved toward the opening 112 in the removal direction 104. Accordingly, the ink supply tube 122 of the joint portion 121 may be removed from the ink flow channel 38 of the ink cartridge 30.

Figure 9:
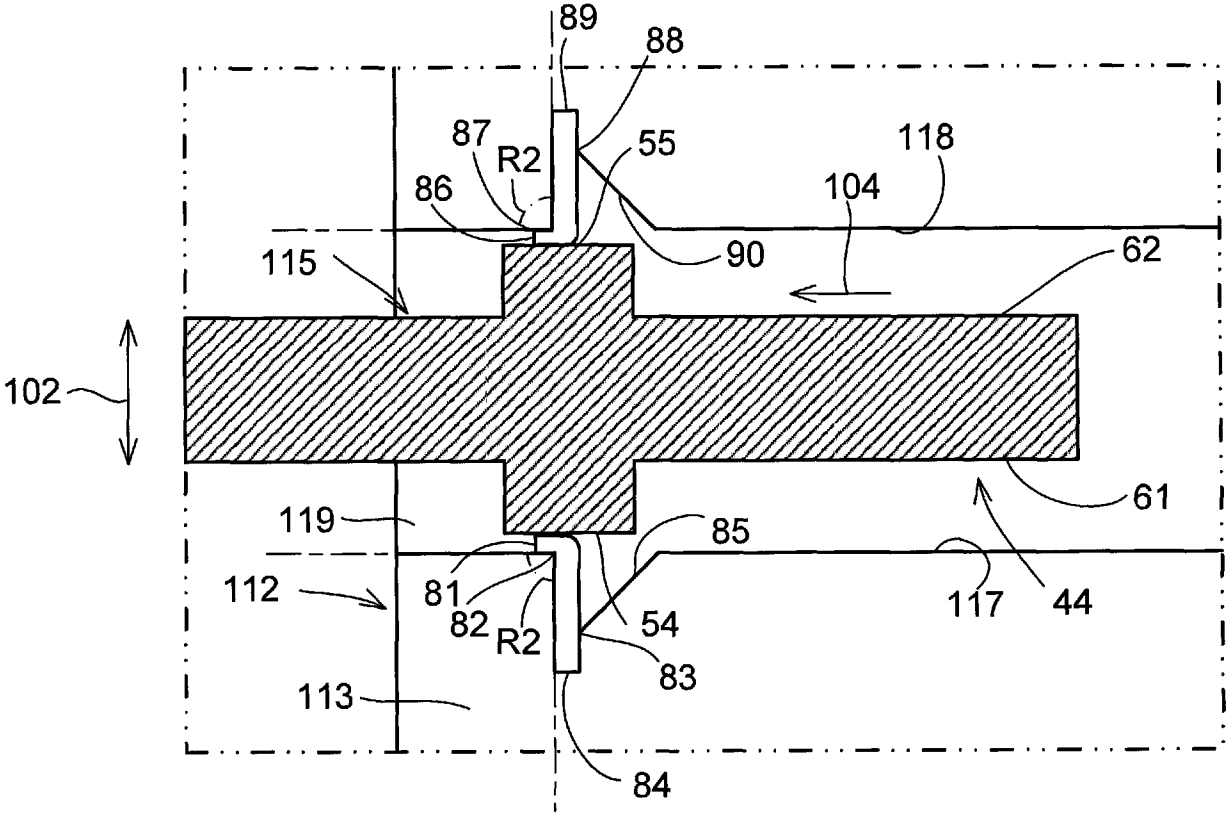
FIG. 9 is an enlarged view of the ink cartridge of FIG. 2 and the mounting portion of FIG. 5 in the vicinity of the contact portions and the stoppers, in which the ink cartridge is removed from the mounting portion 110, corresponding to a cross-sectional view taken along line VIII-VIII in FIG. 7.

After the coil spring 139 has returned to its natural length, the contact portions 54, 55 of the ink cartridge 30 may come into contact with the resilient strips 81, 86 of the stoppers 124, 125, respectively, as shown in FIG. 9.

Referring to FIG. 9, when the contact portion 54 contacts and pushes the resilient strip 81, the resilient strip 81 may be resiliently bent in the removal direction 104. The resilient strip 81 may be bent about the corner 82 as a pivot until the resilient strip 81 comes into contact with the side surface 117. The angle at which the resilient strip 81 is bent is the angle R2, as shown in FIG. 9. In an embodiment of the invention, the angle R2 is 90 degrees. When the resilient strip 81 is fully bent until the resilient strip 81 contacts the side surface 117, the resilient strip 81 may project from the side surface 117 toward the side surface 118 by an amount corresponding to the thickness dimension thereof.

Similarly, when the contact portion 55 contacts the resilient strip 86, the resilient strip 86 may be resiliently bent in the removal direction 104. The resilient strip 86 may be bent about the corner 87 as a pivot until the resilient strip 86 comes into contact with the side surface 118. The angle at which the resilient strip 86 is bent is also the angle R2, which, as described above, is 90 degrees in an embodiment of the invention. When the resilient strip 86 is fully bent until the resilient strip 86 contacts the side surface 118, the resilient strip 86 may project from the side surface 118 toward the side surface 117 by an amount corresponding to the thickness dimension thereof.

When the resilient strips 81, 86 are bent by the contact portions 54, 55 moving in the removal direction 104, the net width of the groove 115 in the horizontal direction 102 may correspond to a distance obtained by subtracting the thicknesses dimensions of the respective resilient strips 81, 86 from the distance between the side surface 117 and the side surface 118 in the horizontal direction 102. The distance between the distal ends of the contact portions 54, 55 in the width direction 51 may be greater than this net width of the groove 115 in the horizontal direction 102. Therefore, the resilient strips 81, 86 may be positioned between the contact portions 54, 55 and the side surfaces 117, 118 and may contact the contact portions 54, 55 and the side surfaces 117, 118 on respective opposite sides, as shown in FIG. 8. The contact portions 54, 55 may move in the removal direction while causing the resilient strips 81, 86 bent along the side surfaces 117, 118 to deform in their thickness dimensions toward the side surfaces 117, 118.

A force required for bending the resilient strips 81, 86 in the removal direction 104 and a force required for deforming the resilient strips 81, 86 in their thickness dimensions act on the ink cartridge 30 which moves in the removal direction 104, and the velocity of the moving ink cartridge 30 may become attenuated and, consequently, the ink cartridge 30 may be stopped. After the ink cartridge 30 has stopped, the ink cartridge 30 is pulled out from the mounting portion 110 by the user. The position where the ink cartridge 30 stops is not limited to the position where the contact portions 54, 55 contact the resilient strips 81, 86 of the stoppers 124, 125. For example, the ink cartridge 30 may move while the contact portions 54, 55 slide on the resilient strips 81, 86, and then the ink cartridge 30 may stop after the contact portions 54, 55 have passed the resilient strips 81, 86.

In an embodiment as described above, when the ink cartridge 30 moves in the removal direction 104 upon receipt of the urging force from the sliding member 135 and the coil spring 139, the contact portions 54, 55 may contact and bend the resilient strips 81, 86 of the stoppers 124, 125 in the removal direction 104. Therefore, the velocity of the moving ink cartridge 30 may be attenuated, and the ink cartridge 30 is stopped. Moreover, when the ink cartridge 30 is removed from the mounting portion 110 in the removal direction 104 and the resilient strips 81, 86 are bent in the removal direction 104, portions of the resilient strips 81, 86 may contact the contact portions 54, 55 and the side surface 117, 118 and may be disposed between and contacted by the contact portions 54, 55 and the side surface 117, 118, while resiliently deforming in their thickness dimensions. Therefore, additional force stopping the ink cartridge 30 may act on the ink cartridge 30. Accordingly, the likelihood that the ink cartridge 30 jumps out of the mounting portion 110 may be reduced.

When the ink cartridge 30 is inserted into the mounting portion 110, the contact portions 54, 55 also may contact and bend the resilient strips 81, 86 in the insertion direction 103. However, because the force required for resiliently bending the resilient strips 81, 86 in the insertion direction 103 is less than the force required for bending the resilient strips 81, 86 in the removal direction 104, a force against the insertion operation of the ink cartridge 30 may be relatively small, and therefore the operational feeling may not be significantly impaired.

Because the resilient strips 81, 86 of the stoppers 124, 125 may be provided at the side surfaces 117, 118 of the groove 115 at the same position in the insertion/removal directions 50, e.g., the resilient strips 81, 86 of the stoppers 124, 125 may be aligned in the horizontal direction 102, movement of the ink cartridge 30 in the horizontal direction 102 relative to the groove 115 of the mounting portion 110 by the contact between the resilient strips 81, 86 and the contact portions 54, 55 may be reduced or eliminated.

The contact portions 54, 55 may be disposed closer to a central interior of the ink cartridge 30 than the right end surface 47 and the left end surface 48 of the main body 31 in the width direction 51. Moreover, the contact portions 54, 55 may not extend outward beyond the right end surface 47 and the left end surface 48 in the width direction 51. Thus, damage or deformation of the contact portions 54, 55 when the ink cartridge 30 is impacted, or when the ink cartridge 30 is packed in a package formed of film and the inside of the package is depressurized, may be reduced or eliminated.

The locking lever 145 may be configured to engage an upper portion of the ink cartridge 30, e.g., the engaging portion 43 of the ink cartridge 30 opposite a lower portion of the ink cartridge 30 where the contact portions 54, 55 are disposed in the direction of gravity. Therefore, the engaging portion 43 may be disposed at its location without interference with the contact portions 54, 55. Thus, the respective elements of the ink cartridge 30 may be flexibly arranged in many different configurations and embodiments.

In an embodiment as described above, the contact portions 54, 55 may be disposed on the ink cartridge 30 and the stoppers 124, 125 are provided on the mounting portion 110. Nevertheless, in another embodiment, only one of the contact portions 54, 55 may be provided on the ink cartridge 30, and only one of the stoppers 124, 125 may be provided on the mounting portion 110. Moreover, in yet another embodiment, a plurality of the contact portions 54, 55 aligned in the insertion/removal directions 50 at intervals may be provided on the ink cartridge 30.

In an embodiment as described above, the corners 82, 83, 87, 88 may be configured to limit the angles at which the resilient strips 81, 86 of the stoppers 124, 125 are bent, such that the force required for bending the resilient strips 81, 86 in the insertion direction 103 is less than the force required for bending the resilient strips 81, 86 in the removal direction 104. Nevertheless, in another embodiment, the force required for bending the resilient strips 81, 86 in the insertion direction 103 may be configured to be less than the force required for bending the resilient strips 81, 86 in the removal direction 104 without the corners 82, 83, 87, 88.

Figure 10:
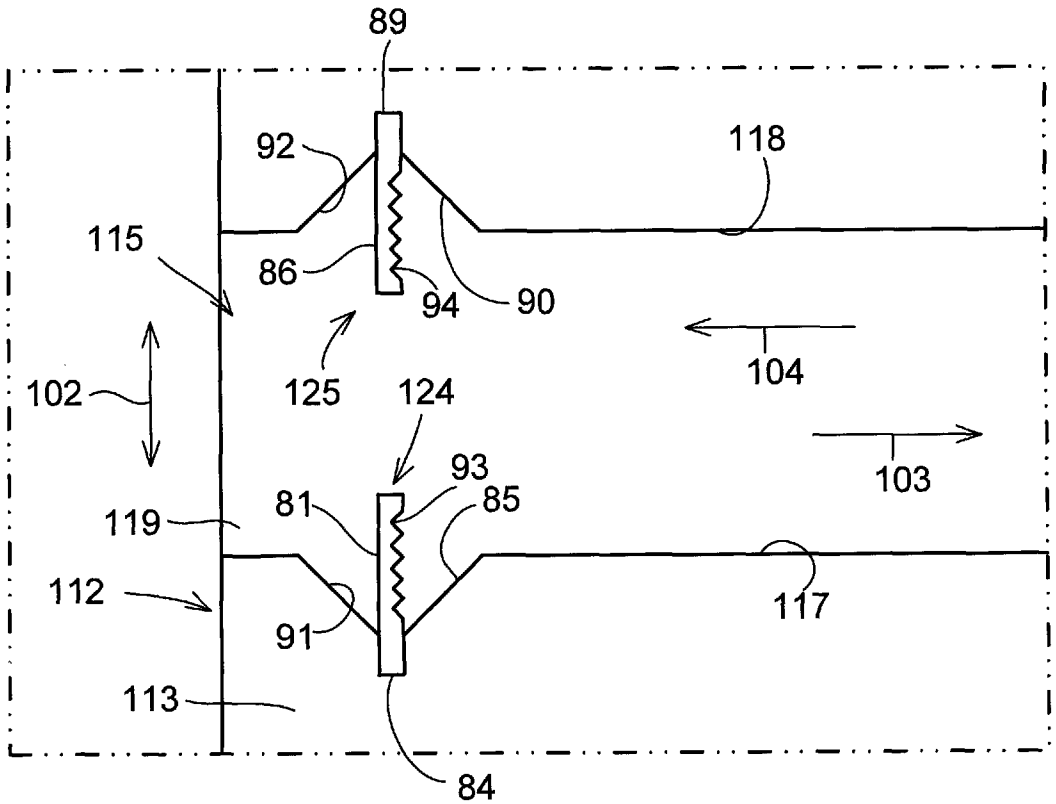
FIG. 10 is an enlarged view of a mounting portion in the vicinity of stoppers, according to another embodiment of the invention.

For example, referring to FIG. 10, in another embodiment of the invention, the stoppers 124, 125 may comprise inclined surfaces 85, 90, 91, 92 on both sides of the recess 84, 89 in the insertion/removal directions 50, and the inclined surfaces 85, 90, 91, 92 may be symmetrical in the insertion/removal directions 50 in relation to the resilient strips 81, 86. A plurality of V-shaped grooves 93, 94 may be formed on a surface of the resilient strips 81, 86 facing a direction opposite the opening 112, e.g., a surface of the resilient strips 81, 86 facing the end portion of the mounting portion 110. Each of the grooves 93, 94 may extend in the vertical direction, e.g., the direction perpendicular to the plane of the paper on which FIG. 10 is illustrated, when the mounting portion 110 is aligned as shown in FIG. 10. The grooves 93, 94 may be arranged in the horizontal direction 102 at particular intervals. The grooves 93, 94 are configured such that the force required for bending the resilient strips 81, 86 in the insertion direction 103 is less than the force required for bending the resilient strips 81, 86 in the removal direction 104. In yet another embodiment, the resilient strips 81, 86 having the grooves 93, 94 formed therein may be combined with the previously described recesses 84, 89 comprising corners 82, 83, 87, 88.

Figure 11:
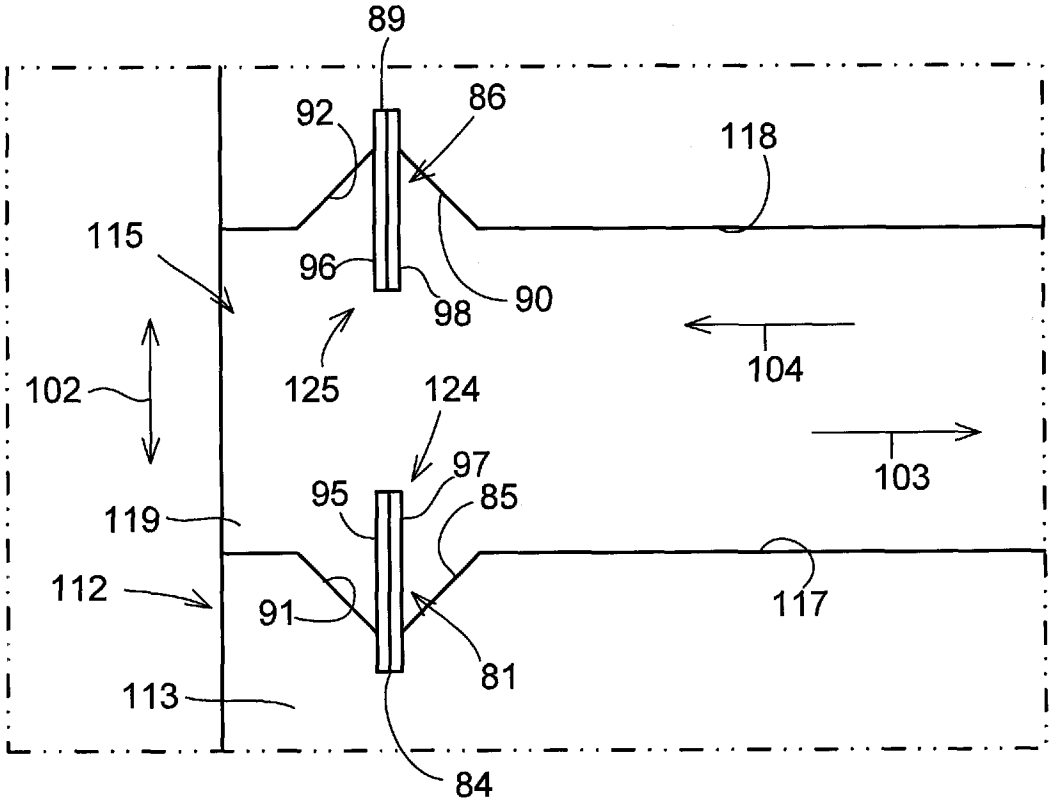
FIG. 11 is an enlarged view of a mounting portion in the vicinity of stoppers, according to yet another embodiment of the invention.

In yet another embodiment of the invention, referring to FIG. 11, the stoppers 124, 125 may comprise the inclined surfaces 85, 90, 91, 92 on both sides of the recess 84, 89 in the insertion/removal directions 50, and the inclined surfaces 85, 90, 91, 92 may be symmetrical in the insertion/removal directions 50 relative to the resilient strips 81, 86. The resilient strips 81, 86 each may be formed by bonding a first member 95, 96 and a second member 97, 98, such that the first member 95, 96 faces the opening 112 and the second member 97, 98 faces the end portion of the mounting portion 110 opposite the opening 112. The rigidity of the first member 95, 96 against bending in the insertion/removal directions 50 may be greater the rigidity of the second member 97, 98 against bending in the insertion/removal directions 50.

Thus, a force required to bend the first member 95, 96 in the insertion/removal directions 50 may be greater than a force required to bend the second member 97, 98 in the insertion/removal directions 50. The first member 95 and the second member 97 may be bonded in their thickness dimensions, e.g., in insertion/removal directions 50, to constitute the single resilient strip 81, and the first member 96 and the second member 98 may be bonded in their thickness dimensions, e.g., in insertion/removal directions 50, to constitute the single resilient strip 86. Accordingly, the force required to bend the resilient strips 81, 86 in the insertion direction 103 may be less than the force required to bend the resilient strips 81, 86 in the removal direction 104. For example, in an embodiment of the invention, the first members 95, 96 may comprise polyethylene terephthalate ("PET") and the second members 97, 98 may comprise nitrile butadiene rubber. In such a case, the first members 95, 96 made of the PET may restrict the extension of the second members 97, 98 made of the nitrile butadiene rubber in its longitudinal direction. In still another embodiment of the invention, these resilient strips 81, 86 comprising the first members 95, 96 and the second members 97, 98 may be combined with the previously described recesses 84, 89 comprising corners 82, 83, 87, 88.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid supply device comprising:

a liquid container comprising:

a liquid chamber configured to store liquid therein;

a liquid supply portion configured to supply the liquid from an interior of the liquid chamber to an exterior of the liquid chamber; and at least one contact portion; and a mounting portion having an opening, a first surface, and a second surface opposite the first surface, wherein the liquid container is configured to be inserted into the mounting portion in an insertion direction via the opening and to be removed from the mounting portion in a removal direction opposite the insertion direction via the opening, the mounting portion comprising:

a joint portion configured to be joined to the liquid supply portion of the liquid container in a mounted state in which the liquid container is mounted in the mounting portion;

an urging member configured to urge the liquid container positioned in the mounting portion toward the opening;

at least one stopper comprising a resilient member extending from at least one of the first surface and the second surface in a direction intersecting the insertion direction, wherein the resilient member is bendably deformable in both the insertion direction and the removal direction, and wherein the resilient member is configured to contact the at least one contact portion when the liquid container is inserted into and removed from the mounting portion; and a retaining member configured to selectively retain the liquid container in the mounting portion against an urging force of the urging member, wherein when the liquid container is mounted in the mounting portion, the at least one contact portion faces the at least one of the first surface and the second surface from which the resilient member of the at least one stopper extends, and the resilient member is configured such that a first force required for deforming the resilient member in the insertion direction is less than a second force required for deforming the resilient member in the removal direction.

2. The liquid supply device of claim 1, wherein the first surface and the second surface each extend in the insertion and removal directions.

3. The liquid supply device of claim 1, wherein the resilient member extends perpendicularly to the insertion direction, and the at least one stopper further comprises a limiter configured to selectively contact the resilient member to limit an amount that the resilient member deforms in the insertion direction as a first angle and to limit an amount that the resilient member deforms in the removal direction as a second angle, wherein the first angle is less than the second angle.

4. The liquid supply device of claim 1, wherein when the liquid container is removed from the mounting portion in the removal direction and the resilient member is deformed in the removal direction, a portion of the resilient member contacts the at least one contact portion and the at least one of the first surface and the second surface, and the portion of the resilient member is positioned between the at least one contact portion and the at least one of the first surface and the second surface, while resiliently deforming in a direction perpendicular to the insertion direction.

5. The liquid supply device of claim 1, wherein the resilient member comprises a first member and a second member, and the first member is positioned closer to the opening than the second member, wherein a rigidity of the first member against deforming in the insertion direction and the removal direction is greater than the rigidity of the second member against deforming in the insertion direction and the removal direction.

6. The liquid supply device of claim 1, wherein the resilient member is formed with a plurality of v-shaped grooves on a surface of the resilient member extending in a direction perpendicular to the insertion direction and facing opposite to the opening.

7. The liquid supply device of claim 1, wherein the resilient member is bendably deformable relative to the at least one of the first surface and the second surface from which the resilient member extends.

8. The liquid supply device of claim 1, wherein the at least one stopper comprises a first stopper and a second stopper, and the resilient member of the first stopper extends from the first surface and the resilient member of the second stopper extends from the second surface, wherein the resilient member of the first stopper and the resilient member of the second stopper are aligned in a direction perpendicular to the insertion direction.

9. The liquid supply device of claim 8, wherein the at least one contact portion comprises a first contact portion and a second contact portion, and the resilient member of the first stopper is configured to contact the first contact portion and the resilient member of the second stopper is configured to contact the second contact portion, when the liquid container is inserted into and removed from the mounting portion.

10. The liquid supply device of claim 1, wherein the mounting portion has a groove extending from the opening in the insertion direction formed therein, and the groove is partially defined by the first surface and the second surface, and wherein the liquid container comprises a guide portion configured to be positioned in and to move in the groove when the liquid container is inserted into and removed from the mounting portion.

11. The liquid supply device of claim 10, wherein the groove extends in a horizontal direction and when the liquid container is mounted in the mounting portion, the groove is positioned underneath the liquid container, and wherein the retaining member is configured to engage an upper portion of the liquid container when the liquid container is mounted in the mounting portion.

12. The liquid supply device of claim 10, wherein the guide portion comprises the at least one contact portion, and the at least one contact portion extends toward the at least one of the first surface and the second surface from which the resilient member extends, when the liquid container is mounted in the mounting portion.

13. The liquid supply device of claim 12, wherein the at least one contact portion extends in a width direction, and the liquid container comprises a main body having a first width in the width direction, and wherein the guide portion has a second width in the width direction, wherein the first width is greater than the second width, and the at least one contact portion is positioned closer to a central interior of the liquid container than an end of the main body, in the width direction.

14. The liquid supply device of claim 12, wherein the at least one contact portion extends in a width direction, and the liquid container comprises a main body having a first width in the width direction, and wherein the guide portion has a second width in the width direction, wherein the first width is greater than the second width, and the at least one contact portion does not extend beyond an end of the main body in the width direction.

15. An image printing apparatus comprising:

a liquid supply device comprising:

a liquid container comprising:

a liquid chamber configured to store liquid therein;

a liquid supply portion configured to supply the liquid from an interior of the liquid chamber to an exterior of the liquid chamber; and at least one contact portion; and a mounting portion having, an opening, a first surface, and a second surface opposite the first surface, wherein the liquid container is configured to be inserted into the mounting portion in an insertion direction via the opening and to be removed from the mounting portion in a removal direction opposite the insertion direction via the opening, the mounting portion comprising:

a joint portion configured to be joined to the liquid supply portion of the liquid container in a mounted state in which the liquid container is mounted in the mounting portion;

an urging member configured to urge the liquid container positioned in the mounting portion toward the opening;

at least one stopper comprising a resilient member extending from at least one of the first surface and the second surface in a direction intersecting the insertion direction, wherein the resilient member is bendably deformable in both the insertion direction and the removal direction, and wherein the resilient member is configured to contact the at least one contact portion when the liquid container is inserted into and removed from the mounting portion; and a retaining member configured to selectively retain the liquid container in the mounting portion against an urging force of the urging member; and a printing portion configured to selectively eject liquid supplied from the liquid supply device, wherein when the liquid container is mounted in the mounting portion, the at least one contact portion faces the at least one of the first surface and the second surface from which the resilient member of the at least one stopper extends, and the resilient member is configured such that a first force required for deforming the resilient member in the insertion direction is less than a second force required for deforming the resilient member in the removal direction.

16. A liquid container configured to be removably inserted into a mounting portion in an insertion direction via an opening, and to be removed from the mounting portion in a removal direction opposite the insertion direction, the liquid container comprising:

a liquid chamber configured to store liquid therein;

a liquid supply portion configured to supply the liquid from an interior of the liquid chamber to an exterior of the liquid chamber, wherein the liquid supply portion is configured to be joined to a joint portion of the mounting portion in a mounted state in which the liquid container is mounted in the mounting portion;

at least one container surface configured to face at least one of a first surface and a second surface opposite the first surface of the mounting portion; and at least one container protrusion extending from the at least one container surface, wherein when the liquid container is inserted into the mounting portion and when the liquid container is removed from the mounting portion, the at least one container protrusion is configured to contact and deform a deformable resilient member extending from at least one of the first surface and the second surface of the mounting portion in a direction intersecting the insertion direction, wherein the at least one container protrusion is configured to exert a first force required for the container protrusion to deform the resilient member in the insertion direction when the liquid container is inserted into the mounting portion, and to exert a second force for deforming the resilient member in the removal direction when the liquid container is removed from the mounting portion, wherein the first force is less than the second force.

17. The liquid container of claim 16, wherein the liquid container is configured to be urged toward the opening of the mounting portion by an urging member when the liquid container is positioned in the mounting portion, and wherein the liquid container is configured to be releasably retained against an urging force from the urging member by a retaining member when the liquid container is positioned in the mounting portion.

18. The liquid container of claim 16, further comprising a guide portion configured to be positioned in and to move in a groove of the mounting portion extending from the opening of the mounting portion in the insertion direction, wherein the at least one container protrusion is positioned at the guide portion.

19. The liquid container of claim 18, further comprising a main body having a first width in a width direction in which the at least one container protrusion extends, wherein the guide portion has a second width in the width direction, wherein the first width is greater than the second width, and the at least one container protrusion is positioned closer to a central interior of the liquid container than an end of the main body in the width direction.

20. The liquid container of claim 18, further comprising a main body having a first width in a width direction in which the at least one container protrusion extends, wherein the guide portion has a second width in the width direction, wherein the first width is greater than the second width, and the at least one container protrusion does not extend beyond an end of the main body in the width direction.

* * * * *